US010485276B2

(12) United States Patent
Price

(10) Patent No.: US 10,485,276 B2
(45) **Date of Patent: *Nov. 26, 2019**

(54) BUOYANT WADERS

(71) Applicant: Lance Price, Columbia, SC (US)

(72) Inventor: Lance Price, Columbia, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/180,130

(22) Filed: Nov. 5, 2018

(65) Prior Publication Data

US 2019/0069613 A1 Mar. 7, 2019

Related U.S. Application Data

(63) Continuation-in-part of application No. 15/622,216, filed on Jun. 14, 2017, now Pat. No. 10,154,696.

(51) Int. Cl.

| | |
|---|---|
| ***A41D 13/02*** | (2006.01) |
| ***A41D 13/012*** | (2006.01) |
| *B63C 9/105* | (2006.01) |

(52) U.S. Cl.

CPC ..... *A41D 13/0125* (2013.01); *A41D 13/02* (2013.01); *A41D 2600/106* (2013.01); *B63C 9/1055* (2013.01)

(58) Field of Classification Search

CPC ... B63C 9/093; B63C 9/105; A41D 2600/106; A41D 13/0125; A41D 7/003; A41D 7/005

See application file for complete search history.

(56) References Cited

U.S. PATENT DOCUMENTS

| | | | | |
|---|---|---|---|---|
| 2,869,152 | A | 2/1956 | Anderson | |
| 2,888,691 | A * | 6/1959 | Manning | A01K 97/00 441/109 |
| 3,154,800 | A | 2/1963 | Anderson | |
| 3,500,485 | A | 4/1968 | Hillary | |
| 3,465,375 | A * | 9/1969 | Schnell | A41D 13/0125 441/109 |
| 6,317,893 | B1 * | 11/2001 | Walton | A41D 13/012 2/227 |
| 7,721,352 | B1 | 5/2010 | Swift | |
| 8,978,164 | B2 | 3/2015 | Jones et al. | |
| 10,154,696 | B1 * | 12/2018 | Price | A41D 13/02 |
| 2008/0076309 | A1 | 3/2008 | Sandrin et al. | |
| 2015/0230523 | A1 * | 8/2015 | Stevenson | A41D 1/08 2/79 |

FOREIGN PATENT DOCUMENTS

| | | |
|---|---|---|
| GB | 2068213 | 8/1981 |

* cited by examiner

*Primary Examiner* — Andrew Polay
(74) *Attorney, Agent, or Firm* — Southeast IP Group, LLC; Thomas L. Moses

(57) ABSTRACT

A wader garment is provided, wherein the wader garment includes buoyant elements that may be employed so that a wearer may float in water, should the need arise, and further includes means for providing a substantially water-tight seal between the waders and a wearer at an upper portion of the waders. The wader garment may also include drainage valves on the leg portions to drain water from waders, if necessary, as well as a urination valve that may be in an open position or a closed position.

13 Claims, 9 Drawing Sheets

BUOYANT WADERS

CROSS REFERENCE TO RELATED APPLICATIONS

The present application is a continuation in part of U.S. application Ser. No. 15/622,216, entitled BUOYANT WADERS, filed on Jun. 14, 2017. All of the foregoing applications are hereby incorporated in their entireties.

TECHNICAL FIELD

The invention relates generally to waders used by outdoorsmen, and particularly fishermen, to protect the wearer from direct exposure to water while the wearer is standing in a body of water. More specifically, the present invention includes a wader garment including buoyant elements that may be employed primarily in connection with chest waders, so that a wearer may float, should the need arise, together with means for providing a substantially water-tight seal between the waders and a wearer.

BACKGROUND OF THE INVENTION

Waders, and particularly chest waders, are commonly used for fishing, construction, scientific experimentation and many other applications, and are useful for wading out into a river or lake, for instance, without the wearer getting wet. Chest waders are, in their basic form, overalls made from a waterproof material such as rubber, neoprene, or the like (or some combination thereof), and oftentimes include shoulder straps that serve as suspenders to keep the waders in the proper position on a wearer.

One danger that chest waders can pose is if a wearer slips on a rock or some other submerged obstacle, the waders may become filled with water, and in extreme cases, can make it difficult for the wearer to swim or stay afloat.

Additionally, if the water is extremely cold or deep, the wearer could be subject to the effects of drowning or exposure.

To overcome these issues, several different types of buoyant waders have been developed. The following references show examples of waders, or other types of similar wearable buoyant protective clothing, that include a buoyant element, and are hereby incorporated herein, in their entireties, by reference:

Patent No. GB2068213A Wader

A wader comprises waterproof pants. The wader extends to the chest region of the wearer and has an inflatable ring chamber 6 near top of the pants. The inflatable chamber provides positive buoyancy when inflated and grips the body of the wearer tightly when inflated to limit the flow of water which can enter the pants.

U.S. Pat. No. 2,869,152—Inflatable Wader Garment

A wader garment to enclose a portion of the human body, comprising legs and a waist portion integral therewith and including a waist band to substantially embrace the body, an inflatable relatively flat sack secured at its lower edge to the inner surface of said waist band and being of a width substantially equal to the distance between said waist band and the armpit of the wearer, said sack conforming to the chest and back portions of said means secured to said sack for inflating the same, and supporting suspenders secured at their ends to the outer surface of said waist band at the front and rear thereof whereby to extend over the shoulders of the wearer in close engagement with the outer surface of said sack to maintain the relative flatness of the sack and to hold the latter tight against the body and with said upper edges adapted to engage in the armpits of the wearer.

U.S. Pat. No. 3,154,800—Life Saving Waders

The present invention relates to life-preserving appliances and more particularly to a pair of Waders with a pair of built in air equalizing pockets for supporting the wearer in an upright manner if the wearer trips while Walking in a stream.

U.S. Pat. No. 3,465,375—Life Guard Chest Waders

A life guard chest waders for use by fishermen and duck hunters, and having a resilient and expandable air chamber secured to the inside top portion of the chest waders to define a built-in life jacket, the air chamber being made to form a substantially water-tight seal between the top of the chest waders and the wearers body when this chamber is inflated, thus preventing any appreciable amount of water from gaining access to the interior of the chest waders and further providing floating buoyancy for the wearer.

U.S. Pat. No. 3,500,485—Automatic Wader Floatation Ring

Wader apparatus comprising a generally inelastic outer water impermeable shell adapted to receive and confine the lower portion of the body of the wearer and having a top adapted to encircle the body of the wearer, a generally flexible inelastic inner wall substantially commensurate with the said outer water impermeable shell, a generally flexible gas impermeable shell interposed between said inner and outer walls and being generally coextensive therewith and including an upper inflatable floatation ring chamber; the gas impermeable shell being adapted to entrap a volume of air therewithin, the volume being generally sufficient to inflate said floatation ring chamber upon the exposure to hydrostatic pressure encountered when the wearer enters the water.

U.S. Pat. No. 7,721,352—Inflatable Wader Garment Assembly

An inflatable wader garment assembly includes a lower body covering with a pair of leg coverings and a lower torso covering. The lower body covering has an upper edge including a front edge and a back edge. A bladder has a top wall, a bottom wall and a perimeter wall extending between the top and bottom walls. The bladder is U-shaped and has a central portion and a pair of legs. Each of the legs has a distal end with respect to the central portion. A tube is fluidly coupled to the bladder. Air may be blown through the tube to inflate the bladder. Front straps are coupled to the distal ends and to the front edge. At least one rear strap is attached to the central portion and is attached to the back edge.

U.S. Pat. No. 8,978,164—Wader Pants System with Inflatable Membranes

A system for providing a secure fit between feet and/or ankles of an individual and boot sections of wader pants may include wader pants including boot sections, and wader support pants configured to be positioned underneath or over the wader pants. The wader support pants may include inflatable membranes configured to be disposed within or on the boot sections of the wader pants, and a pump in fluid communication with the inflatable membranes. The pump is operable to inflate the membranes to provide a secure fit between the boot sections of the wader pants and the feet and/or ankles of the individual.

Application No. 20080076309—Life-Saving Clothing

Life-saving clothing, in particular for protecting against drowning persons in danger during travelling in water or any other liquid element. The life-saving clothing (1) includes a part encompassing the trunk of a users body and is characterized in that the part has inflatable floating elements (3) which is made of a non-extensible material and is arranged in such a way that it takes a folded shape in the uninflated state thereof and forms a float around the user's trunk in the inflated state and the clothing (1) is provided with inflating elements (9) for the floating means. In a preferred embodiment, the volume of floating elements (3) is distributed substantially in front of and behind the user. The life-saving clothing (1) ensures the stable position of the user in such a way that the respiratory tract thereof is free.

Each of these above-referenced waders and wearable floatation gear has disadvantages. For instance, although these waders all include some type of floatation element, none of them effectively prevent water from getting inside the waders, and thus, the wearer is still subject to exposure from cold water. Secondly, all of the waders mentioned above are generally loose-fitting garments, which means that they do not provide much protection from the cold air or water.

Therefore, it would be desirable to provide a pair of chest waders that includes a buoyant element to provide floatation of the wearer, which may include an inflatable portion, or may include a buoyant material affixed to the waders. Further, it would be desirable to provide a pair of chest waders that could provide a substantially water-tight seal against a user's body or clothing, which significantly reduces or eliminates the problem of water entering the waders and coming into contact with a wearer's body. Additionally, it would be desirable to provide means for draining water from the waders while being worn by a user, if necessary, as well as a urination valve that may be in an open position when in use, and in a closed position, when not in use.

SUMMARY OF THE INVENTION

The above objectives are accomplished according to the present invention by providing, in a first embodiment, a gas impermeable inflatable floatation ring around the upper portion of the waders, so that the inflatable portion surrounds a person's chest, sides and back. Preferably, the inflatable ring is positioned on the inside portion of the waders, so that when the inflatable chamber is inflated, the inflatable ring expands to form a substantially water-tight seal between the upper portion of the waders and the wearer's body or external clothing.

In another embodiment, the inflatable chamber may form a U-shape that engages the user's back, sides, and portions of the user's front. A zipper may be employed on a front portion of the waders, extending downwardly from the top of the waders on a front side. The ends of the inflatable chamber are preferably adjacent the zipper, so that the zipper may be zipped or unzipped while the inflatable portion is either in the inflated state or the deflated state, allowing ease of access for the wearer to put on or take off the waders.

In yet another embodiment of the present invention, a non-inflatable buoyant element may simply be attached to a mesh pocket (or any other suitable pocket, sleeve or attachment means) carried by the waders.

In any or all of these embodiments, cinch straps may be used to tighten the inflatable portion against the wearer's body, in order to provide a tighter seal against water. The cinch strap may encircle the entire inflatable portion or buoyant element, or may simply extend from each side on a front portion of the wader. The cinch straps are commonly used on outdoor equipment, and in one embodiment, comprise ends which may snap fit together, wherein at least one end has means for adjusting (loosening or tightening) the strap. Further, a cinch strap may be employed directly below the inflatable portion or the buoyant element, also for the purpose of providing a tight water seal between the wearer and the waders.

Additional features may include valves positioned on the leg portions of the waders, preferably below the knee, that allow water to drain from the waders while being worn by a user, if necessary, as well as a urination valve. Optionally, an inflatable section may be included adjacent a wearer's back, preferably between the wearer's shoulder blades or near the neck area.

DESCRIPTION OF THE DRAWINGS

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
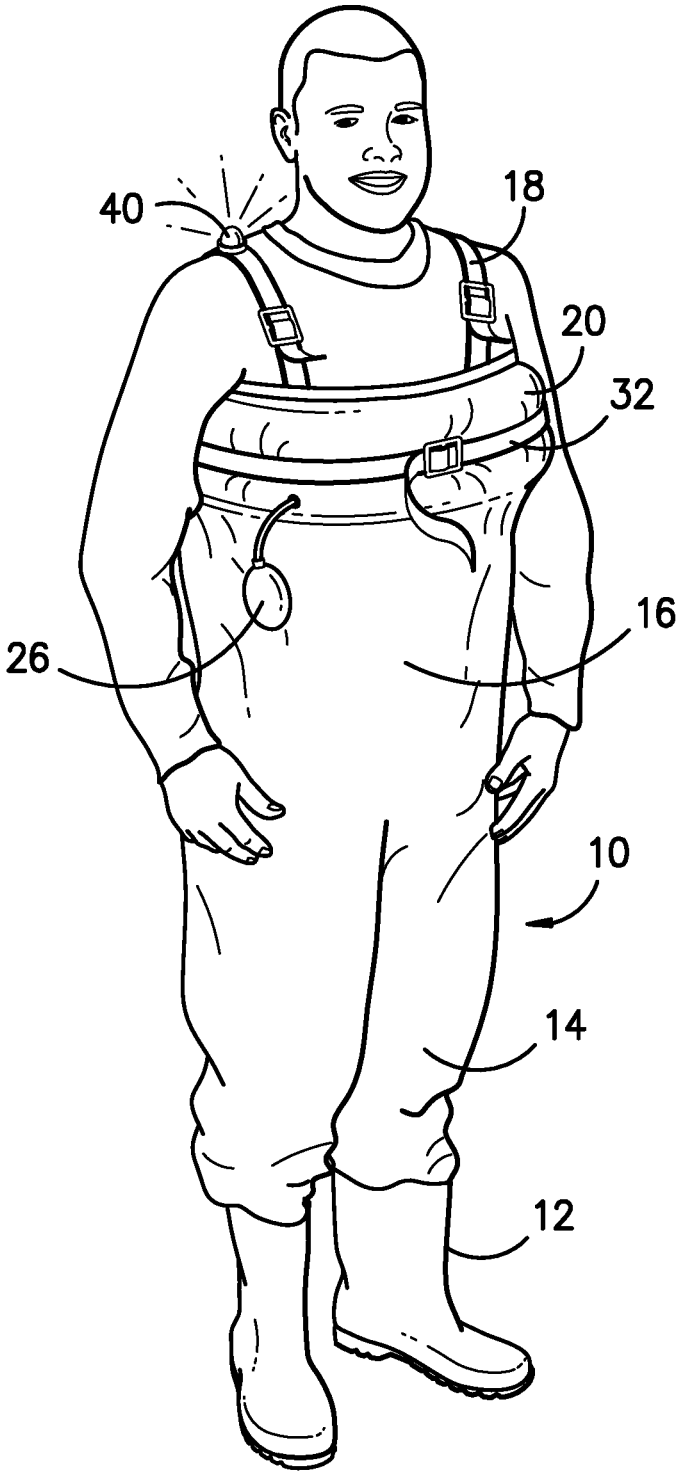
FIG. 1 is a perspective view of one embodiment of the buoyant waders, including an inflatable floatation ring encircling the chest, sides and back of the wearer, and further including a hand pump for inflating the floatation ring, a light source disposed on the suspender strap, and a cinch strap disposed on an outer portion of the inflatable floatation ring.

Referring now to the drawings, the invention will be described in more detail. A pair of waders 10, in a first embodiment, includes boot portions 12, leg portions 14, a torso portion 16, and a pair of suspender straps 18 to fit over a wearer's shoulders. The waders 10 are made from a waterproof or water impervious material, to prevent water from seeping through the material. Such material may include rubber, neoprene, or any other suitable material, including combinations thereof. In this embodiment, an inflatable ring 20 is attached to an upper portion of the waders 10, preferably on an inner side of the waders 10, so that the inflatable ring 20 surrounds a wearer's chest, sides (under and adjacent a wearer's armpits), and back. The inflatable ring 20 is made from a gas impermeable material, and preferably exhibits some elastic qualities.

Figure 2:
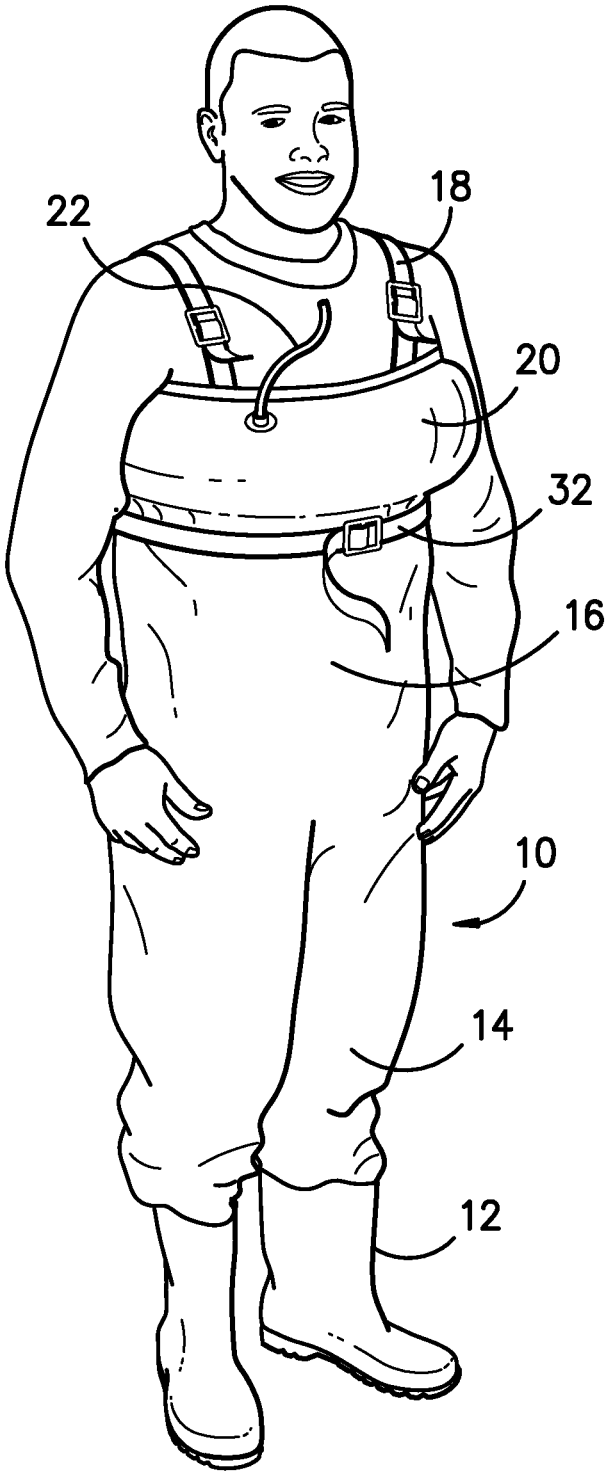
FIG. 2 is a perspective view of one embodiment of the buoyant waders, including an inflatable floatation ring encircling the chest, sides and back of the wearer, and further including a manual blow tube for inflating the floatation ring and a cinch strap disposed below the inflatable floatation ring.
Figure 7:
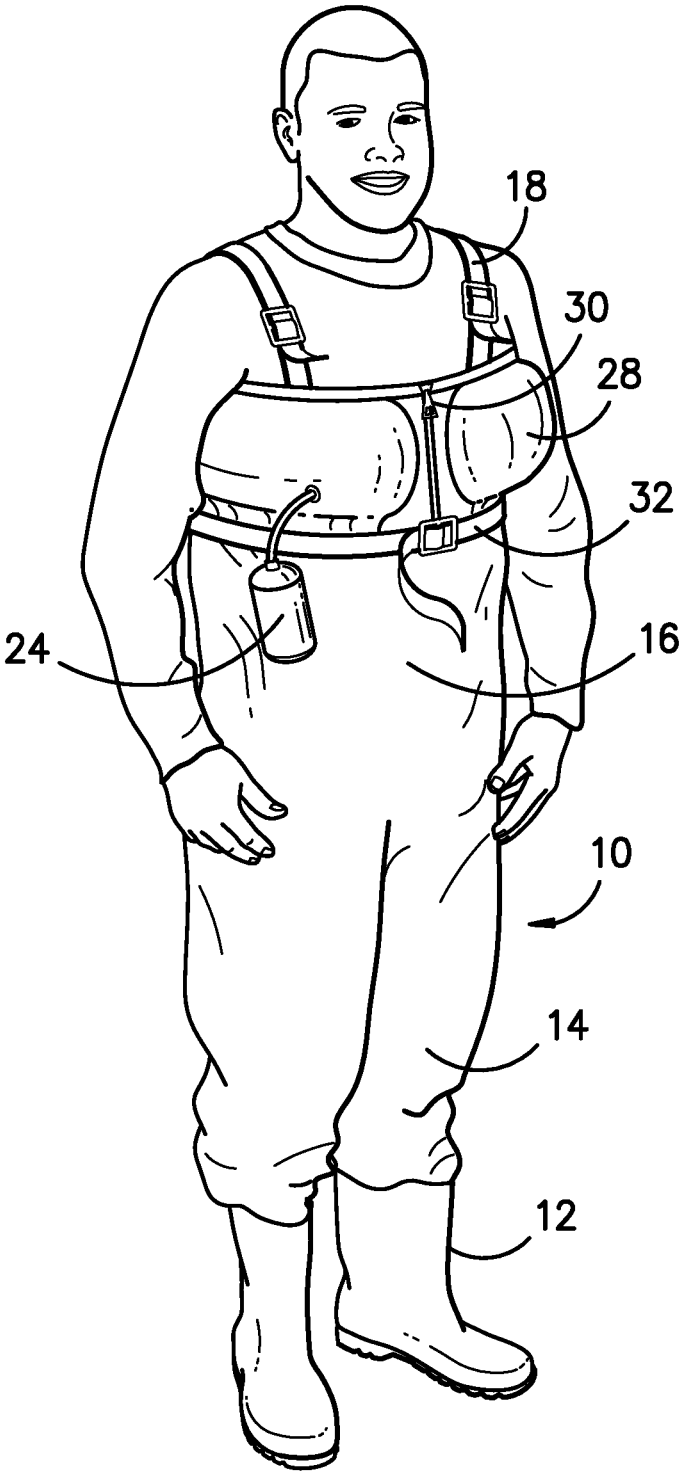
FIG. 7 is a perspective view of another embodiment of the buoyant waders, showing a U-shaped inflation chamber and a zipper extending down a front portion of the waders, and further showing a compressed gas cylinder for inflating the inflation chamber.

The inflatable ring 20 may be inflated manually, by blowing into a tube 22 that is in operative communication with the inflatable ring 20 (as shown in FIG. 2), and includes a one-way valve that allows air to enter the inflatable ring but does not allow air to escape, similarly to life preservers commonly used on commercial airliners. Alternatively, a $CO_2$ canister 24 (or canister containing any suitable inert compressed gas, as shown in FIG. 7), or a small hand pump 26 (similar to that of a blood pressure monitor, shown in FIG. 1) may be operatively connected to the inflatable ring 20. It should be understood that these or other commonly used methods for inflating an inflatable object may be used on any or all of the embodiments described herein, including the inflatable ring 20, the U-shaped inflation chamber 28, or any other inflatable element. Additionally, it contemplated that both a manual inflation mechanism and a canister of compressed gas 24 may be employed, as desired, wherein the canister of compressed gas 24 is primarily used for quick inflation during an emergency or crisis. Preferably, the compressed gas canister 24 is attached to the waders on a front portion thereof, so that it provides easy access for a wearer to activate it in an emergency, although the canister 24 may be positioned anywhere on the waders 10, including in a pocket, so long as the canister 24 is operatively connected to the inflation chamber 20, 28. In a preferred embodiment, the portion of the inflation chamber 28 or inflation ring 20 that is adjacent a wearer's armpits may be formed more narrowly than the remainder of the chamber, in order to provide additional range of motion for the wearer's arms.

In another embodiment, rather than having an inflatable ring 20, the waders may include a generally U-shaped inflation chamber 28 that wraps around the sides and back, terminating on each side at a zipper 30 disposed in a vertical position at a central location on the front of the waders 10, as shown in FIG. 7. The zipper 30 allows a user easier access to put on or take off the waders 10, and is commonly found on various types of waders 10. The zipper 30 preferably extends from the top of the waders 10 downwardly, terminating anywhere between the user's crotch and mid-torso (or any desirable length). Further, the zipper 30 may include material positioned underneath or behind the zipper portion (between the zipper and the wearer), wherein the material provides a waterproof barrier, so that any water that may leak through the zipper 30 is prevented from leaking into the waders 10 and coming into contact with the wearer's clothing or body.

Figure 4:
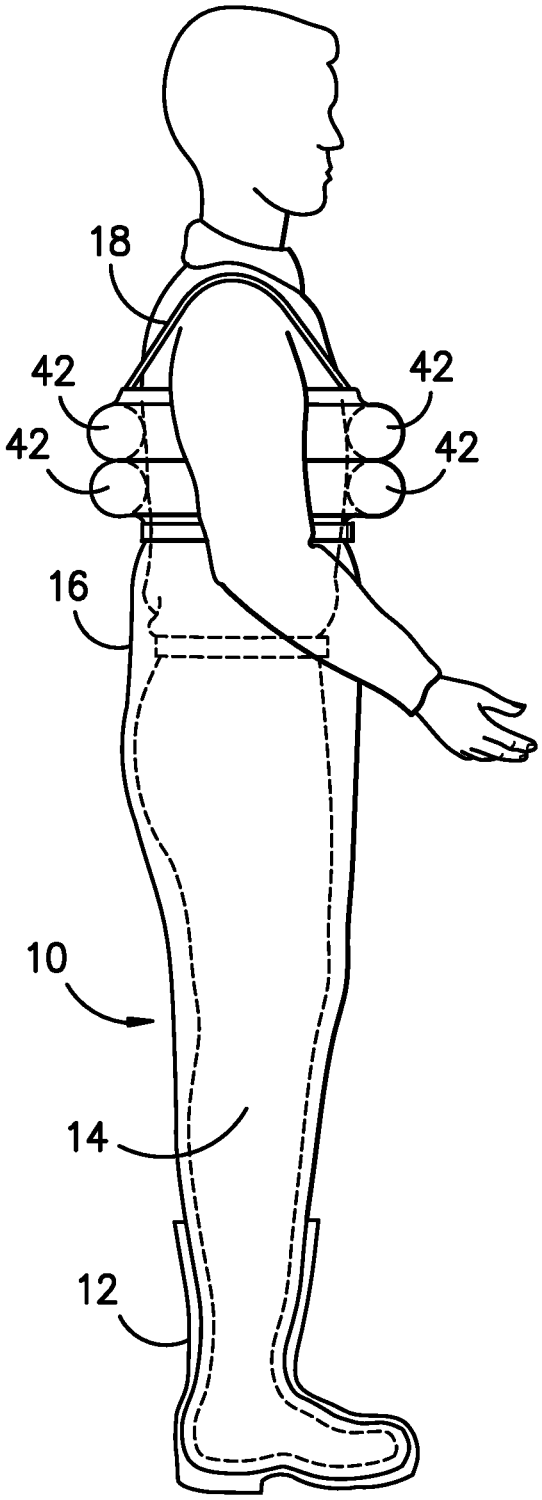
FIG. 4 is a side view of one embodiment of the buoyant waders, including an inflatable floatation ring having two separately inflatable compartments encircling the chest, sides and back of the wearer, and further including a cinch strap disposed below the inflatable floatation ring.

Optionally, the inflatable ring 20 or inflation chamber 28 may be formed into multiple compartments 42, as shown in FIG. 4. In one embodiment, the inflatable ring 20 may comprise two separate inflation compartments 42 that encircle the wearer's body at the opening of the waders 10. Similarly, the U-shaped inflation chamber 28 may be divided into two compartments 42, which are preferably adjacent to one another. In this way, if one inflation compartment 42 is punctured or becomes deflated, the second compartment 42 remains inflated in order to maintain buoyancy. Multiple inflation compartments 42 may be formed into any desired configuration to form an inflation chamber 28 or ring 20, provided that each separate compartment 42 preferably includes means for inflating and deflating, as desired.

In order to provide and maintain a substantially water-tight seal at the upper opening of the waders 10, it is contemplated that cinch straps 32, or other adjustable tightening means, may be used. The cinch strap 32 may be placed about an outer portion of the inflation ring 20 or chamber 28, so that the cinch strap 32 puts pressure on the inflation chamber 28 to form a seal against the body of the wearer. Alternatively, a cinch strap 32 may be positioned above or below the inflation ring 20 or chamber 28. Any combination of these cinch strap 32 positions may be used, so that multiple cinch straps 32 form multiple seals between the waders 10 and the user's body. The purpose of the cinch straps 32 is to prevent water from leaking into the waders 10 from the upper opening adjacent the wearer's chest and back.

Figure 5:
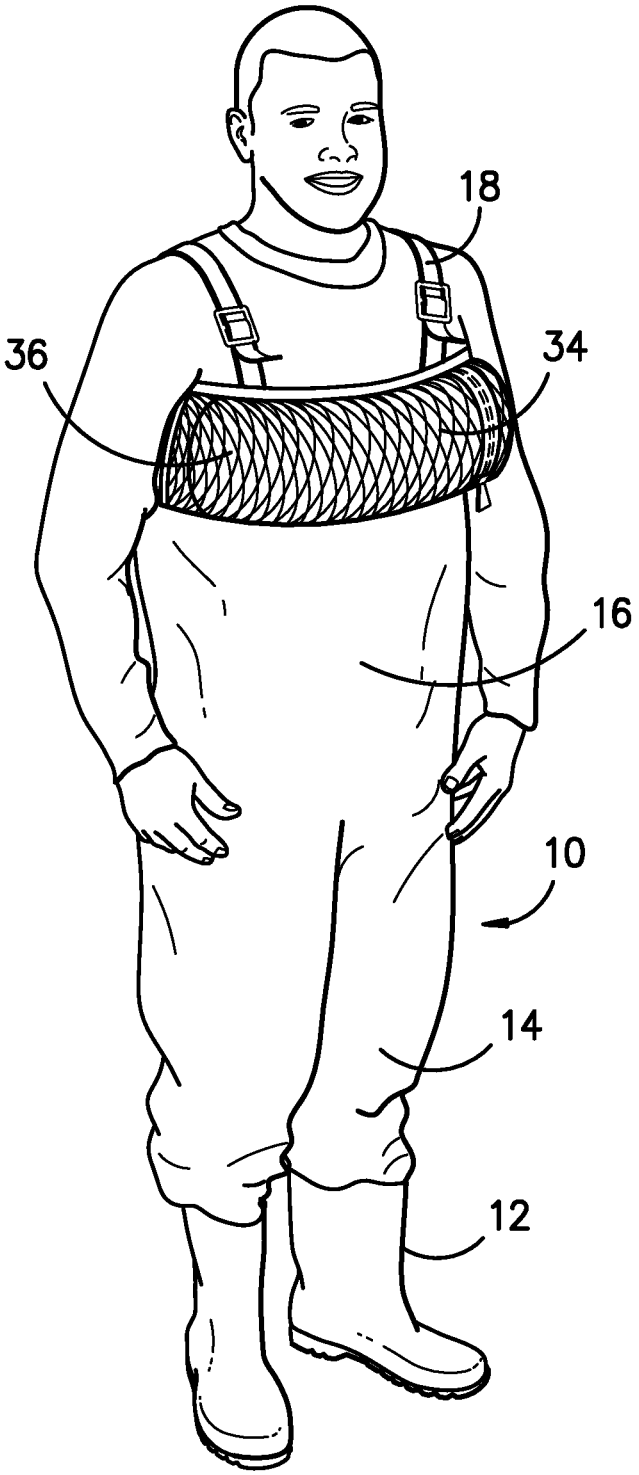
FIG. 5 is a perspective view of another embodiment of the buoyant waders, including a non-inflatable buoyant element disposed within a mesh sleeve that encircles the chest, sides and back of the wearer.
Figure 6:
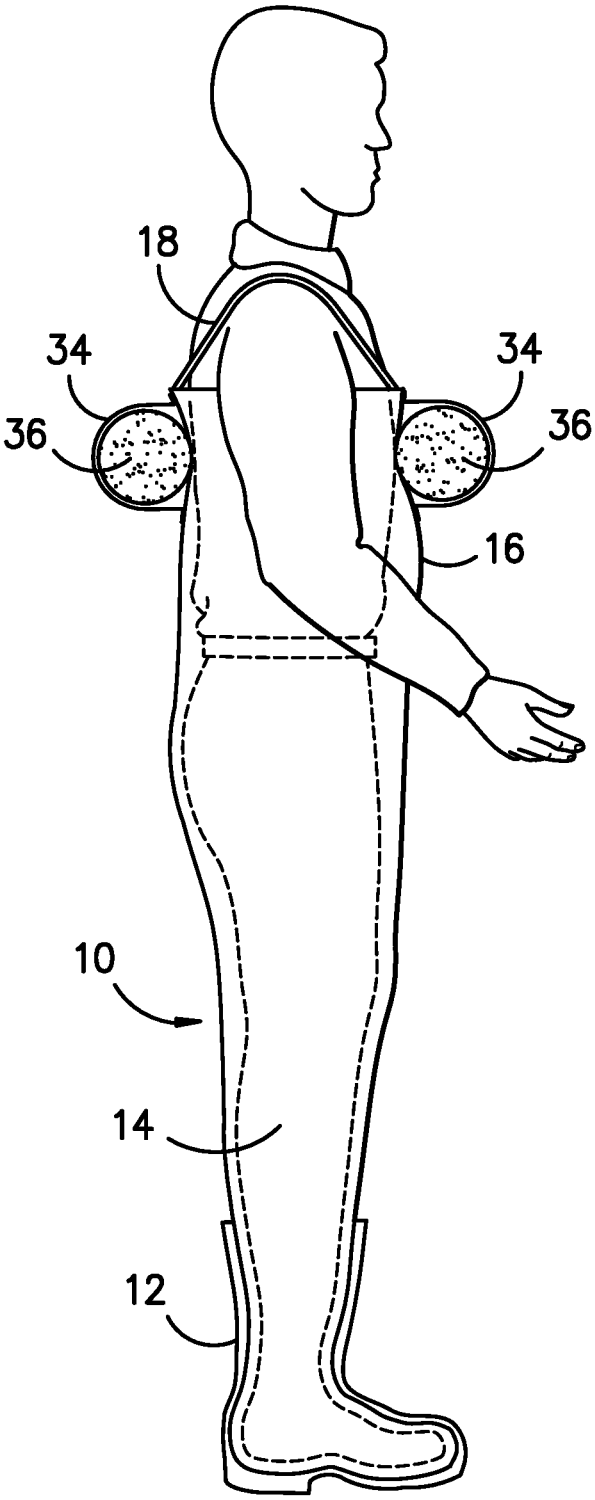
FIG. 6 is a side view of the embodiment shown in FIG. 5, showing the non-inflatable buoyant element disposed within a mesh sleeve that encircles the chest, sides and back of the wearer.

In yet another embodiment, the waders may include a pocket or sleeve 34 around the upper periphery of the waders 10, surrounding the chest, sides and back, that may receive a removable buoyant material 36, as shown in FIGS. 5 and 6. In this embodiment, a wearer may slide a buoyant "noodle" 36 into the sleeve 34, which is attached to the waders 10, in order to provide buoyancy. As used herein, the term "noodle" is defined as a buoyant material, such as foam or any other suitable material, formed into a length that generally corresponds to the length of the sleeve attached to the waders 10, and is generally circular in cross-sectional shape, although any desired shape may be used. In a preferred embodiment, the sleeve 34 is made from a mesh material, so that it does not retain water therein. The noodle 36 is preferably insertable into the sleeve 34, and removable as desired. If desired, the noodle 36 may be permanently positioned within the sleeve 34, as well. In the noodle embodiment, a cinch strap 32 is preferably positioned below the sleeve 34, so that the cinch strap 32 may be tightened down against the wearer's body in order to provide a substantially water-tight seal. It may be desirable to place a cinch strap 32 above the sleeve 34, either along with the cinch strap 32 below the sleeve 34 or instead of the cinch strap 32 below the sleeve 34.

Figure 3:
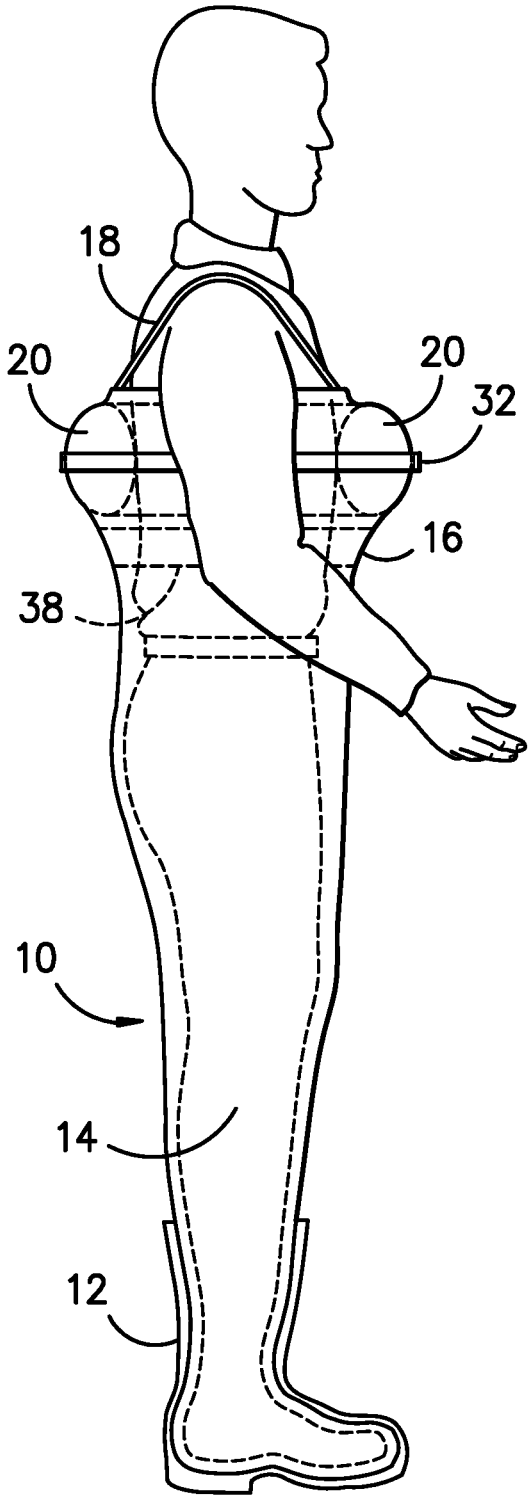
FIG. 3 is a side view of one embodiment of the buoyant waders, including an inflatable floatation ring encircling the chest, sides and back of the wearer, and further including a strip of wicking material positioned on an inner portion of the waders below the floatation ring and a cinch strap disposed on an outer portion of the inflatable floatation ring.

Optionally, a strip of absorbent or wicking material 38 may be placed on an inner portion of the waders 10 adjacent the inflation ring 20 or chamber 28, as shown in FIG. 3. The absorbent strip 38 may be above, below or on an inner side of the inflation ring 20 or chamber 28, and may also be placed according to the cinch straps 32, on an inner surface thereof, so that the cinch straps 32 tend to tighten down against the absorbent strip 38. In this way, if water does leak through the opening in the waders 10, the absorbent strip 38 may absorb water to prevent the water from leaking further into the bottom of the waders 10. Additionally, multiple absorbent strips 38 may be placed within the waders 10, and positioned as desired.

Another optional component that may be included in the present waders is a light source 40, preferably attached to an upper portion of the waders 10, or on the suspender straps 18, as shown in FIG. 1. In one embodiment, the light source 40 may include a flashing strobe, either illuminating white light or colored light, so that a wearer may be visible to others after dark or in dark places. Alternatively, the light source 40 may comprise a glow stick, which is commonly used in outdoor activities, and uses a combination of chemicals mixed together to provide temporary illumination. The light source 40 may be attached to the waders in any suitable manner, and at any desirable position or location. It is contemplated that the light source 40 may be water-activated, so that when the light source 40 is exposed to or immersed in water, the light source 40 is activated and becomes illuminated.

Figure 8:
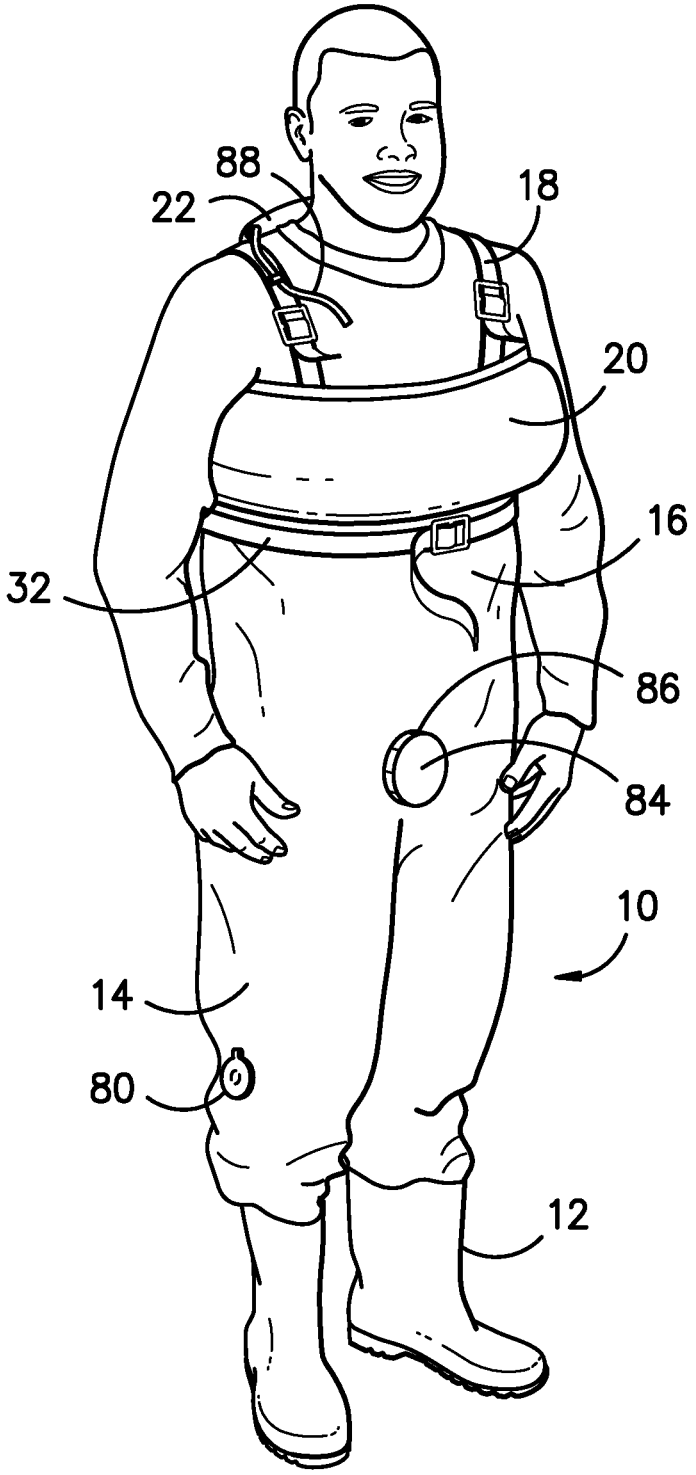
FIG. 8 is a perspective view of another embodiment of the buoyant waders, including valves for draining water from the waders while they are being worn by a person, and further including a urination valve.
Figure 9:
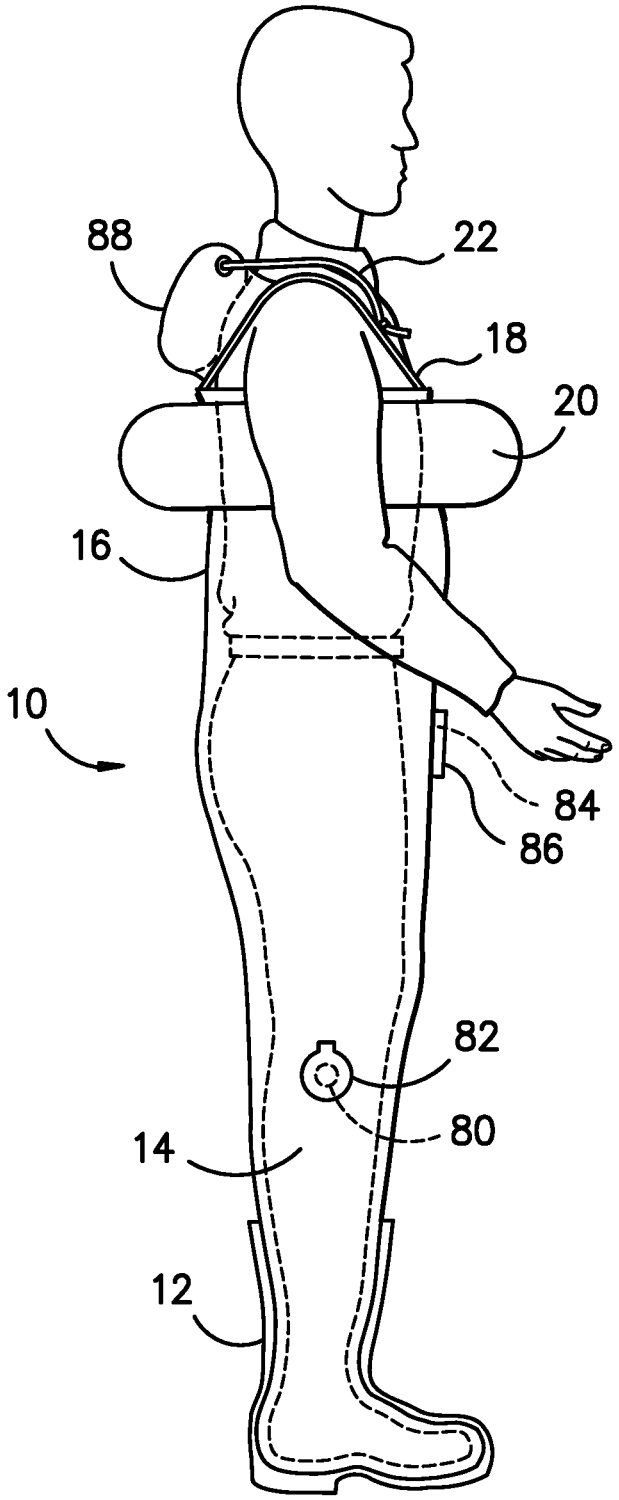
FIG. 9 is a side view of another embodiment of the buoyant waders, including drainage valves on the leg portions, a urination valve, and an additional inflatable/buoyant portion positioned against a wearer's back.
Figure 10:
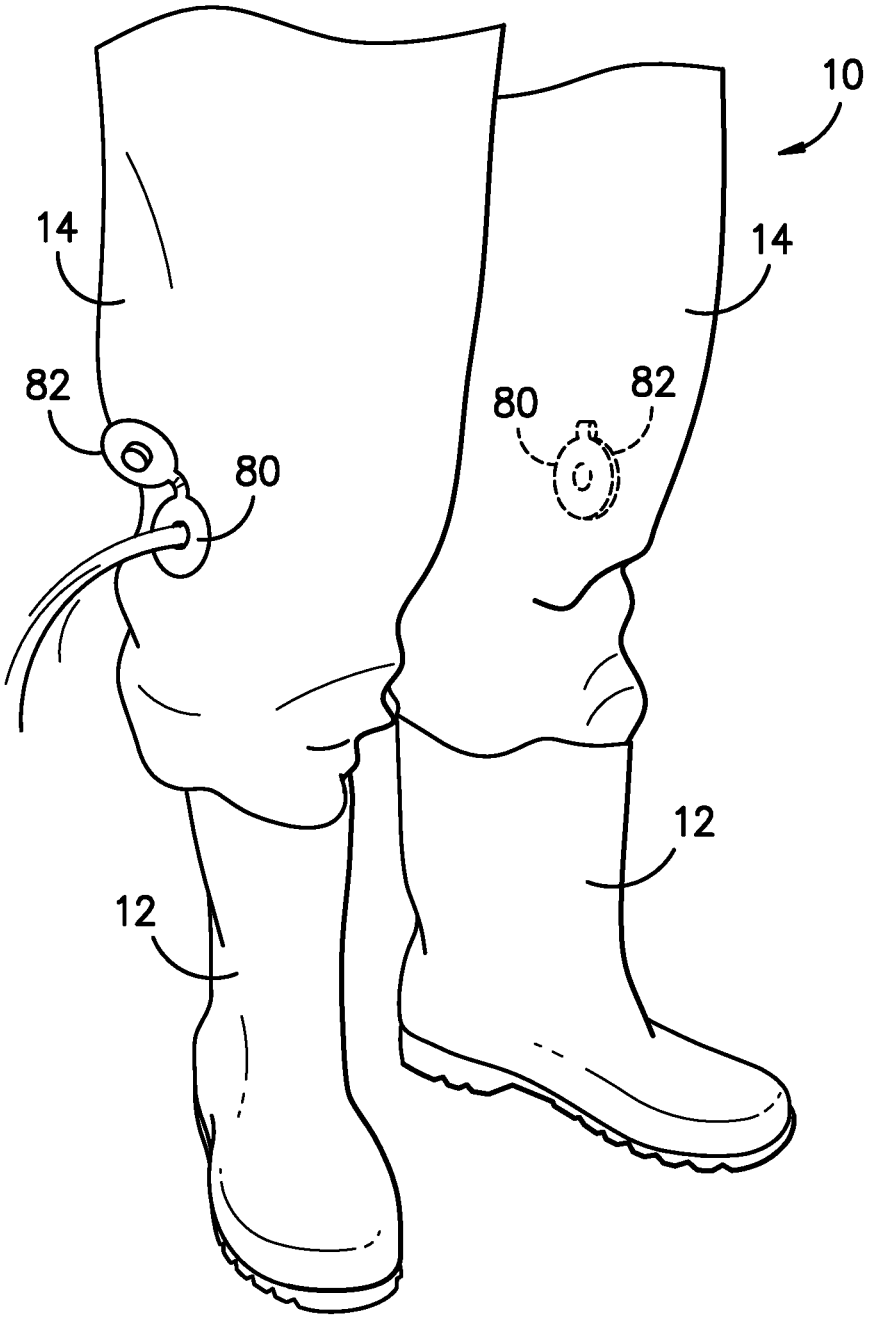
FIG. 10 is a perspective view of one embodiment of the waders, showing drainage valves in the leg portions, and further showing removable cap members that may be in an open position for draining water, or may be in a closed position to maintain a water-tight seal against water entering the waders through the drainage valves.

Optionally, if waders become filled with water, means for draining the water may be provided. In one embodiment, drainage valves 80 may be positioned on the leg portions 14, preferably below the knee as shown in FIGS. 8-10. These valves 80 may be any suitable valves, and may have removable caps 82 for releasing water from the waders while preventing water from entering when the caps 82 are in place on the valves 80. The caps 82 may be threaded and screwed on to the valves 80, may be snap-fit thereon, or may be removably attached in any suitable manner. Alternatively, the valves 80 may be one-way valves, that allow water to flow outwardly from the waders, but that do not allow water to enter the waders from the outside. All of these types of valves are well-known in the art, and may resemble the one-way valves commonly used on inflatable rafts and water toys.

One other optional feature is a urination valve 84 that is positioned on the crotch area of the waders, as shown in FIGS. 8 and 9. The urination valve 84 preferably includes a removable cap member 86 that is water-tight when positioned on the urination valve 84, but may be removed by a user for purposes of urination, so that the user is not required to remove the waders from his body in order to urinate.

Another optional feature is a buoyant or inflatable rear cushion member 88 that is attached to the waders on a rear portion thereof for supporting a wearer's back or neck while in the water. This rear cushion 88 feature may be made of a buoyant foam or other buoyant material, or may be inflatable using the same inflation and deflation methods and apparatuses described hereinbefore, including a compressed gas cartridge, a blow tube, a one-way air valve, or any other suitable inflation/deflation assembly. An example of the buoyant rear cushion member 88 is shown in FIG. 9.

Although the present invention has been described in considerable detail with reference to certain preferred versions thereof, other versions are possible. Therefore, the spirit and scope of the appended claims should not be limited to the description of the preferred versions contained herein. All features disclosed in this specification may be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A wader garment assembly comprising:

a lower body covering including a pair of leg coverings and a lower torso covering, said leg coverings each having a bottom end comprising a foot covering, said lower body covering having an upper edge forming an opening into said lower body covering;

a drainage valve positioned on at least one leg portion of said wader garment to allow water to drain from said wader garment;

an inflation chamber attached to said wader garment, wherein said inflation chamber may be inflated and deflated by a user, as desired, to provide buoyancy in water; and a urination valve positioned between said leg coverings that may be opened so that a user may urinate through said valve and may also be in a closed position when not in use.

2. The wader garment assembly set forth in claim 1, wherein said inflatable chamber is positioned on an inner side of said lower body covering adjacent said upper edge thereof;

said inflatable chamber being formed into a ring, and being made from a gas-impermeable, elastic material, and including means for receiving and expelling gas for inflation and deflation of said inflatable chamber;

wherein said inflation chamber, upon becoming inflated, expands inwardly from said lower body covering, thereby decreasing the size of said opening into said lower body opening in order to form a water resistant seal between said waders and a wearer.

3. The wader garment set forth in claim 1, further comprising at least one cinch strap attached to an outer portion of said waders, wherein said cinch strap may be adjusted to tighten or loosen said waders against a wearer's body.

4. The wader garment set forth in claim 1, wherein said inflatable chamber comprises at least two separate compartments, so that if one compartment is punctured or becomes deflated, said second compartment remains inflated.

5. The wader garment set forth in claim 1, wherein said drainage valve is a one-way valve that allows water to drain from an inner portion of the wader garment, but does not allow water to enter an interior portion of the wader garment through said drainage valve from outside thereof.

6. The wader garment set forth in claim 1, further including a compressed air canister operatively connected to said inflatable chamber, so that a wearer may activate said compressed air canister to inflate said inflatable chamber.

7. The wader garment set forth in claim 1, wherein said inflation chamber is positioned on a rear portion of said lower torso covering.

8. The wader garment set forth in claim 1, wherein said inflation chamber is selected from the group consisting of a single inflatable ring, a plurality of inflatable rings, a single U-shaped chamber, a U-shaped chamber having multiple compartments, and a single inflatable ring having multiple compartments.

9. A wader garment assembly comprising:

a lower body covering including a pair of leg coverings and a lower torso covering, said leg coverings each having a bottom end comprising a foot covering, said lower body covering having an upper edge forming an opening into said lower body covering;

a sleeve connected to an outer portion of said wader garment, said sleeve having an opening on at least one end thereof;

a length of buoyant material removably disposed within said sleeve, so that said length of buoyant material may be slid into or out of said opening of said sleeve;

a urination valve positioned between said leg coverings, wherein said urination valve may be opened so that a user may urinate through said valve, and may also be in a closed position when not in use; and wherein said sleeve is made from a mesh material, so that said sleeve does not retain water therein while said sleeve is not immersed in water.

10. The wader garment set forth in claim 9, further including at least one drainage valve positioned on one of said leg coverings.

11. The wader garment set forth in claim 9, wherein said buoyant material is made from buoyant foam.

12. The wader garment set forth in claim 10, wherein said drainage valve is a one-way valve that allows water to drain from an inner portion of the wader garment, but does not allow water to enter an interior portion of the wader garment through said drainage valve from outside thereof.

13. The wader garment set forth in claim 10, wherein a drainage valve is positioned on each leg covering on a lower portion thereof.

* * * * *